US010674277B2

(12) United States Patent
Song

(10) Patent No.: US 10,674,277 B2
(45) Date of Patent: Jun. 2, 2020

(54) SPEAKER

(71) Applicant: AAC Technologies Pte. Ltd., Singapore (SG)

(72) Inventor: Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,069

(22) Filed: Jul. 28, 2019

(65) Prior Publication Data

US 2020/0045455 A1 Feb. 6, 2020

(30) Foreign Application Priority Data

Aug. 4, 2018 (CN) ..... 2018 1 0881152

(51) Int. Cl.
*H04R 9/06* (2006.01)
*H04R 9/02* (2006.01)
*H04R 7/18* (2006.01)

(52) U.S. Cl.
CPC ..... *H04R 9/06* (2013.01); *H04R 7/18* (2013.01); *H04R 9/025* (2013.01); *H04R 2400/11* (2013.01); *H04R 2499/11* (2013.01)

(58) Field of Classification Search
CPC ..... H04R 9/06; H04R 9/025; H04R 9/043; H04R 7/18; H04R 2400/11; H04R 2499/11
USPC ..... 381/396, 398, 400, 412, 420
See application file for complete search history.

(56) References Cited

U.S. PATENT DOCUMENTS 6,542,617 B1 * 4/2003 Fujihira ..... H04R 9/04 381/402
2004/0086150 A1 * 5/2004 Stiles ..... H04R 9/025 381/421
2004/0245864 A1 * 12/2004 Bailey ..... H04R 9/04 310/15
2007/0237353 A1 * 10/2007 Stiles ..... H04R 9/06 381/418
2012/0207339 A1 * 8/2012 Babb ..... H02K 9/16 381/400
2015/0271605 A1 * 9/2015 Zhang ..... H04R 9/043 381/401

* cited by examiner

*Primary Examiner* — Jason R Kurr
(74) *Attorney, Agent, or Firm* — W&G Law Group LLP

(57) ABSTRACT

The speaker as disclosed by the present invention includes a lower plate carrying an outer magnet assembly and an inner magnet assembly. The outer magnet assembly and the inner magnet assembly form a magnetic gap. The speaker further includes a suspension received in the magnetic gap for supporting a voice coil. The outer magnet assembly includes an outer main magnet, a top plate stacked on the outer main magnet, and an auxiliary magnet stacked on the top plate. The outer main magnet and the top plate are such configured that the magnetic gap has an inner diameter, along a direction from the diaphragm toward the lower plate, gradually increasing and then gradually decreasing. The suspension locates at the region having the greatest inner diameter.

8 Claims, 6 Drawing Sheets

SPEAKER

FIELD OF THE PRESENT DISCLOSURE

The present disclosure relates to the field of electromagnetic transducers, more particularly to a speaker used in a portable electronic device.

DESCRIPTION OF RELATED ART

A speaker is a very important component equipped in a mobile phone for producing audible sounds. A speaker generally uses a diaphragm to produce vibration and further to generate sounds.

In order to adapt to miniaturization and multifunctional development of various audio equipment and information communication equipment, the speaker used in the equipment is more likely to be more miniaturized. The matching of other elements on the periphery of the loudspeaker is more compact. The vibration system and the magnetic circuit system of the speaker are directly connected with the sound quality of the speaker. The vibration system of a related speaker comprises a vibrating diaphragm and a voice coil assembly attached to the vibrating diaphragm. The magnetic circuit system comprises a yoke and a magnet arranged in the yoke. The coil is fixedly supported by only the vibrating diaphragm, and when the vibrating system vibrates, unbalanced vibration is easily generated. The power is required to be reduced to meet the balance of the vibration system, and therefore the power of the vibration system is limited. So that the acoustic performance of the speaker using the vibration system is limited. Therefore, an improved speaker is desired.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby are only to explain the disclosure, not intended to limit the disclosure.

Figure 1:
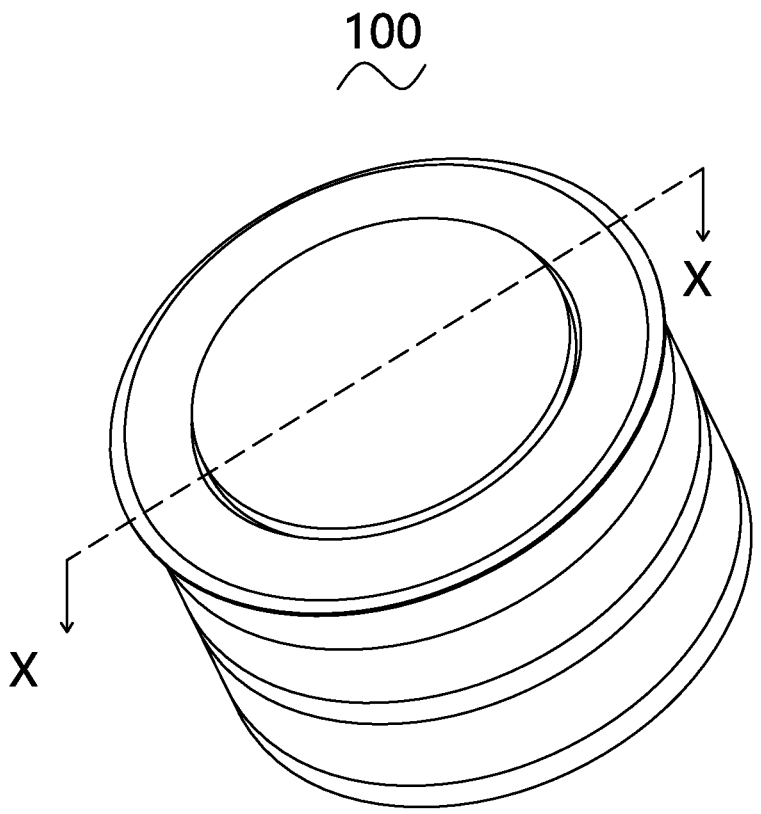
FIG. 1 is an isometric view of a speaker in accordance with a first exemplary embodiment of the present disclosure.
Figure 2:
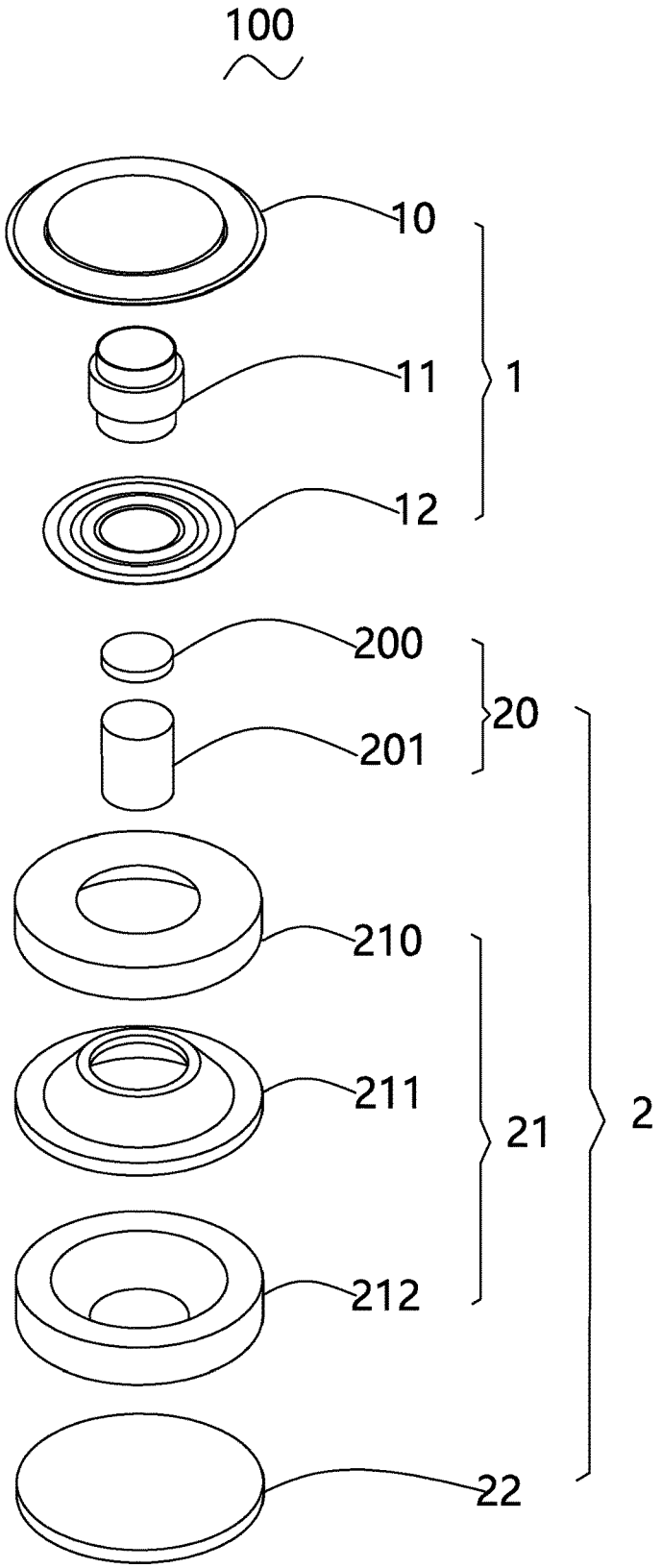
FIG. 2 is exploded view of the speaker in FIG. 1.
Figure 3:
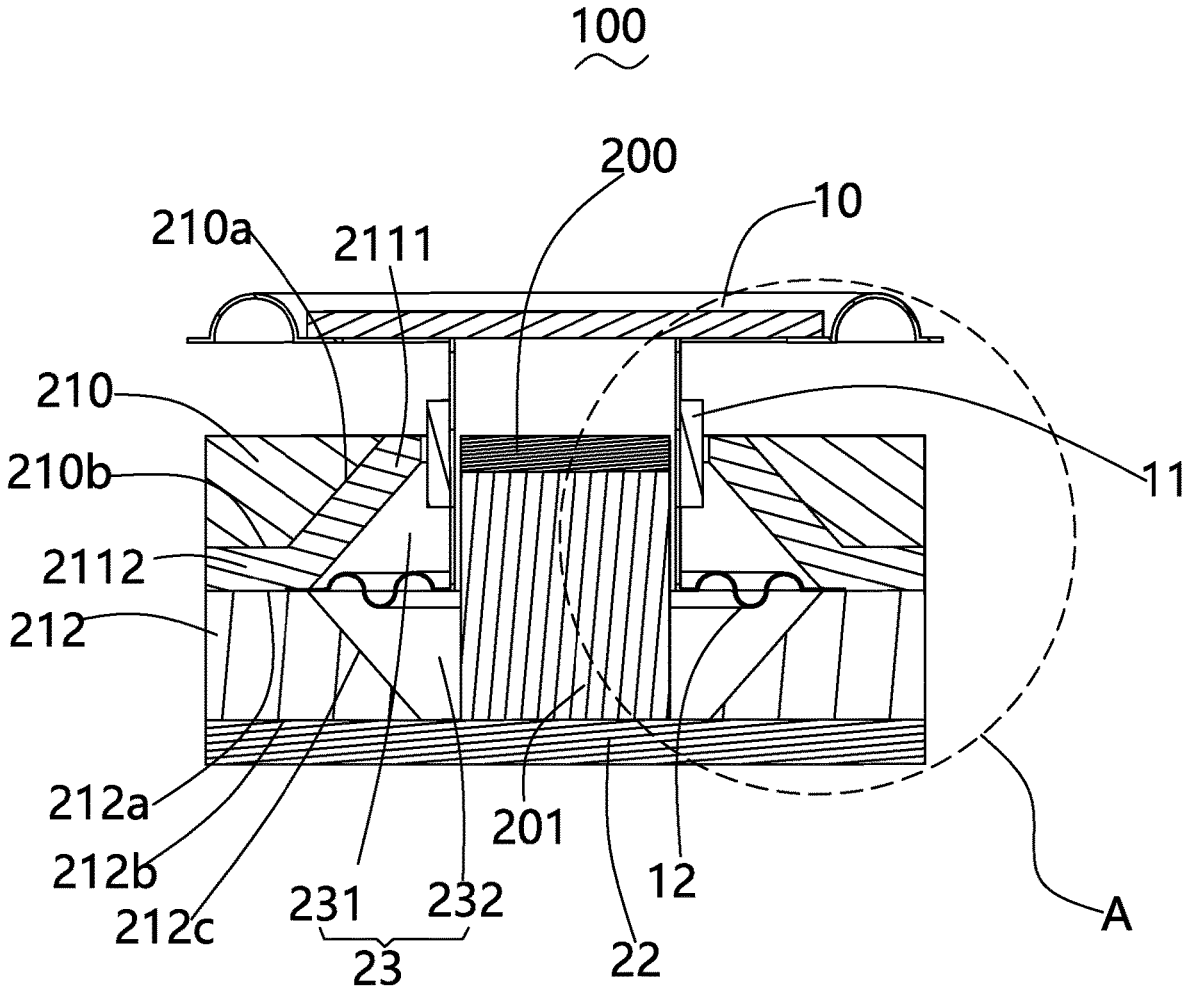
FIG. 3 is a cross-sectional view of the speaker in FIG. 1, taken along line X-X.

Referring to FIGS. 1-3, a speaker 100, in accordance with an exemplary embodiment of the present disclosure, includes a vibration system 1 and a magnetic circuit system 2 for interacting with the vibration system 1 to produce sounds.

The vibration system 1 includes a diaphragm 10, a voice coil 11 for driving the diaphragm 10 to vibrate, and a suspension 12 connecting to an end of the voice coil 11 far away from the diaphragm 10. The diaphragm 10 serves as a sound-radiation surface driven by the voice coil 11. The voice coil 11 is connected to the diaphragm 10 directly or indirectly.

The magnetic circuit system 2 is used for producing magnetic field to interact with the voice coil 11. When electrified, the voice coil 11 is driven by Ampere Force produced by the interaction between the electrified voice coil 11 and the magnetic circuit system 2. The magnetic circuit system 2 includes a lower plate 22 made of magnetic conductive material, an outer magnet assembly 21 mounted on the lower plate 22, and an inner magnet assembly 20 surrounded by the outer magnet assembly 21. The inner magnet assembly 20 includes an inner main magnet 201 located at a central portion of the lower plate 22, and a first upper plate 200 covering the inner main magnet 201. The outer magnet assembly 21 substantially surrounds the inner magnet assembly 20. The outer magnet assembly 21 includes an outer main magnet 212 mounted on the lower plate 22 and surrounds the inner main magnet 201, a second upper plate 211 stacked on the outer main magnet 212, and a ring-shaped auxiliary magnet 210 carried by the second upper plate 211. The outer magnet assembly has a through hole for providing a space to accommodate the inner magnet assembly 20 therein.

Referring to FIGS. 2 and 3, a magnetic gap 23 is formed between the inner magnet assembly 20 and the outer magnet assembly 21. The voice coil 11 partially receives in the magnetic gap 23. A gap formed between the second upper plate 211 and the inner magnet assembly 20 is defined as a first gap 231, and a gap formed between the outer main magnet 212 and the inner magnet assembly 20 is defined as a second gap 232. The combination of the first and second gaps 231, 232 defines the magnetic gap 23. The speaker 100 further includes a suspension 12 located in the magnetic gap 23.

The outer main magnet 212 includes a first surface 212*a* for engaging with the second upper plate 211, a second surface 212*b* mounted on the lower plate 22, and an first side 212*c* connecting the first surface 212*a* to the second surface 212*b*. The first side 212*c* extends from the second surface 212*b* obliquely along a direction away from the inner main magnet 201, which makes an inner diameter of the outer main magnet 212 gradually increased along a direction from the lower plate 22 to toward the diaphragm 10. The second upper plate 211 includes a first portion 2112 substantially parallel to the lower plate 22 and engaging with the first surface 212*a* of the outer main magnet 212, and a second portion 2111 extending from the first portion 2112 obliquely along a direction toward the inner main magnet 201, which makes an inner diameter of the second upper plate 211 gradually decreased along a direction from the lower plate 22 toward the diaphragm 10. The configuration of the outer main magnet 212 and the second top plate 211 provides an enlarged space (magnetic gap) for receiving the suspension 12 therein. The auxiliary magnet 210 engages with the second top plate 211. In detail, the auxiliary magnet 210 includes a third surface 210*b* engages with the first portion 2112 of the second top plate 211 and a fourth surface 210*a* engages with the second portion 2111 of the second top plate 211, which provides a complementary configuration between the auxiliary magnet 210 and the second top plate 211. As a best mode, the suspension 12 locates at the region with the greatest inner diameter of the magnetic gap 23.

Figure 4:
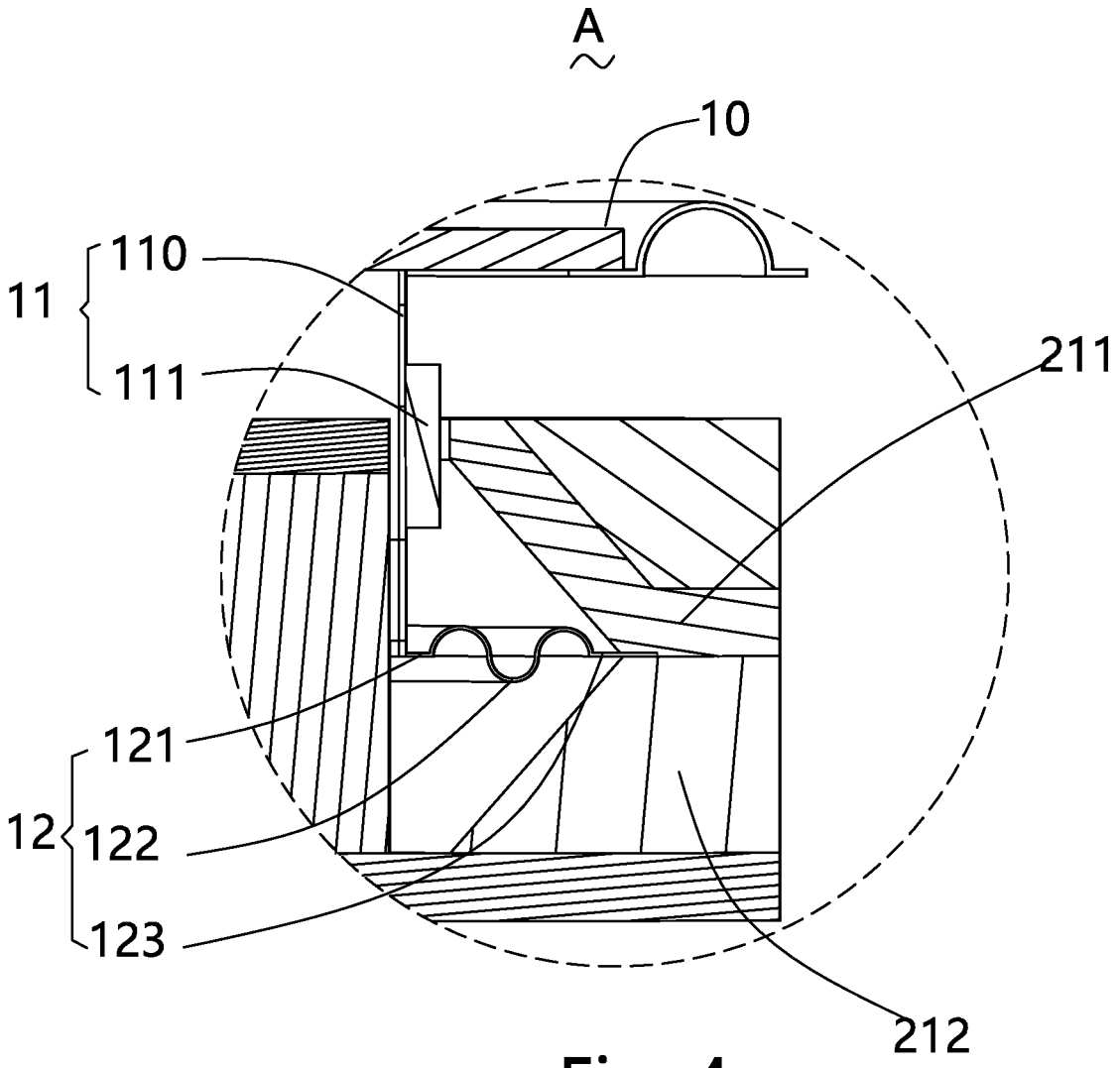
FIG. 4 is an enlarged view of Part A in FIG. 3.

Referring to FIG. 4, the suspension 12 includes a supporting arm 121 connected to an end of the voice coil 11 far away from the diaphragm 10 and suspending the voice coil 11 in the magnetic gap, a fixing arm 123 sandwiched between the second upper plate 211 and the outer main magnet 212, and an elastic arm 122 connecting the fixing arm 123 to the supporting arm 121. The suspension 12 is used for supporting the coil assembly for providing balanced vibration to the diaphragm. In the embodiment, the voice coil includes a frame 110 and a coil 111 wound around the frame 110. The suspension is connected to the frame for supporting the voice coil. Optionally, the voice coil can only include a coil without a frame.

Figure 5:
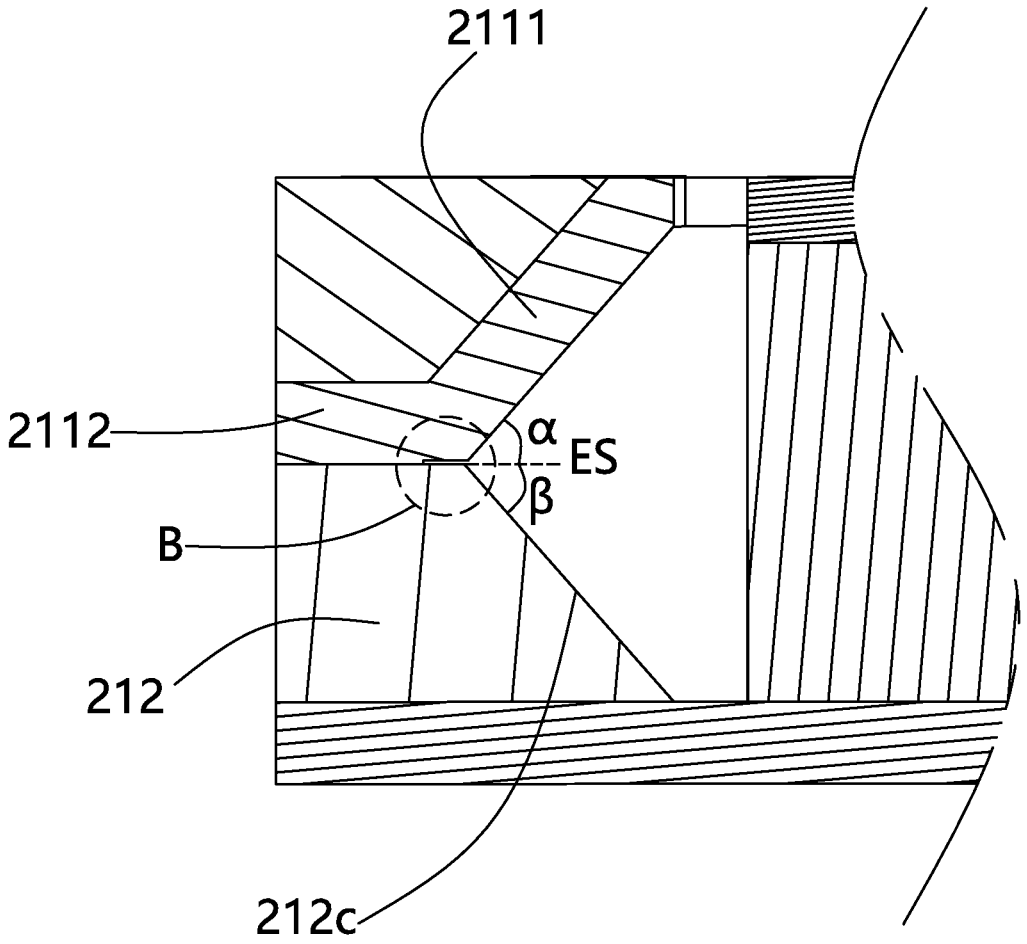
FIG. 5 is a broken cross-sectional view of magnetic circuit system of the speaker.

Referring to FIG. 5, the first portion 2112 of the second upper plate and the outer main magnet 212 cooperatively form an engaging surface ES. The second portion 2111 forms a first angel α with the engaging surface ES, and the first side 212*c* forms a second angle β with the engaging surface ES. In the embodiment, the first angle α equal to the second angle β. The first and second angles can be adjusted according to actual requirements.

Figure 6:
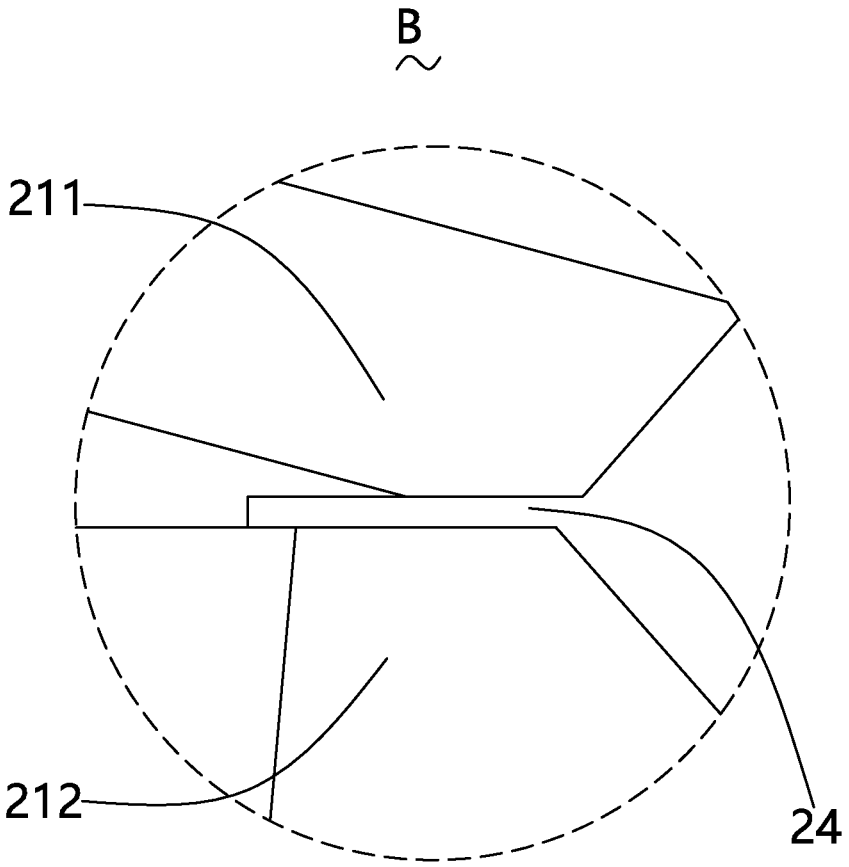
FIG. 6 is an enlarged view of Part B in FIG. 5.

Referring to FIG. 6, the second upper plate 211 and the outer main magnet 212 cooperatively form a receiving slot to fixing the fixing arm of the suspension.

The speaker as disclosed by the present invention includes a lower plate carrying an outer magnet assembly and an inner magnet assembly. The outer magnet assembly and the inner magnet assembly form a magnetic gap. The speaker further includes a suspension received in the magnetic gap for supporting a voice coil. The outer magnet assembly includes an outer main magnet, a top plate stacked on the outer main magnet, and an auxiliary magnet stacked on the top plate. The outer main magnet and the top plate are such configured that the magnetic gap has an inner diameter, along a direction from the diaphragm toward the lower plate, gradually increasing and then gradually decreasing. The suspension locates at the region having the greatest inner diameter.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, comprising:

a vibration system including a diaphragm and a voice coil for driving the diaphragm to vibrate along a vibration direction;

a magnetic circuit system including:

a lower plate;

an inner magnet assembly having an inner main magnet mounted on the lower plate and a first upper plate covering the inner main magnet;

an outer magnet assembly having an outer main magnet mounted on the lower plate and surrounding the inner main magnet, a second upper plate stacked on the outer main magnet, and an auxiliary magnet engaging with the second upper plate so that the auxiliary magnet is separated from the inner main magnet by the second upper plate;

a magnetic gap formed cooperatively by the inner main magnet, the second upper plate and the outer main magnet;

a suspension received in the magnetic gap, having a supporting arm suspending one end of the coil assembly far away from the diaphragm and a fixing arm fixed by the magnetic circuit system; wherein the second upper plate and the outer main magnet are such configured that the magnetic gap has an inner diameter gradually increasing and then gradually decreasing along a direction from the diaphragm toward the lower plate.

2. The speaker as described in claim 1, wherein the second upper plate includes a first portion substantially parallel to the lower plate, and a second portion extends obliquely from the first portion toward the diaphragm so that an inner diameter of the second upper plate decreases along a direction from the lower plate toward the diaphragm.

3. The speaker as described in claim 2, wherein the auxiliary magnet includes a surface engaging with the first portion of the second upper plate and another surface engaging with the second portion so that the auxiliary magnet and the second upper plate provide a complementary structure.

4. The speaker as described in claim 1, wherein the outer main magnet includes a first surface engaging with the second upper plate, second surface engaging with the lower plate and a first side connecting the first surface to the second surface, the first side is such configured that an inner diameter of the outer main magnet increases gradually along a direction from the lower plate toward the diaphragm.

5. The speaker as described in claim 1, wherein the magnetic circuit system includes a receiving slot for fixing the fixing arm of the suspension.

6. The speaker as described in claim 5, wherein the receiving slot is cooperatively formed by the second upper plate and the outer main magnet.

7. The speaker as described in claim 5, wherein the second upper plate and the outer main magnet form an engaging surface where the inner diameter of the magnetic gap is the greatest, and the suspension is disposed at the region where the engaging surface locates.

8. The speaker as described in claim 1, wherein the voice coil includes a frame a coil wound around the frame.

* * * * *